US008176698B2

(12) United States Patent
Lewark

(10) Patent No.: US 8,176,698 B2
(45) Date of Patent: May 15, 2012

(54) PANEL

(75) Inventor: Matthias Lewark, Kremmen (DE)

(73) Assignee: Kronotec AG, Luzern (CH)

( * ) Notice: Subject to any disclaimer, the term of this patent is extended or adjusted under 35 U.S.C. 154(b) by 1069 days.

(21) Appl. No.: 10/944,427

(22) Filed: Sep. 20, 2004

(65) Prior Publication Data

US 2005/0076598 A1 Apr. 14, 2005

(30) Foreign Application Priority Data

Oct. 11, 2003 (DE) ..... 203 15 676 U

(51) Int. Cl.
*E04B 5/00* (2006.01)
*B44F 9/02* (2006.01)

(52) U.S. Cl. ..... 52/316; 52/592.1; 52/313; 428/151

(58) Field of Classification Search ..... 52/591.4, 52/589.1, 592.1, 316, 313, 311.1, 592.2, 52/592.3, 591.1, 591.3, 390, 592.4; 428/151, 428/157

See application file for complete search history.

(56) References Cited

U.S. PATENT DOCUMENTS

| | | | | |
|---|---|---|---|---|
| 213,740 | A | 4/1879 | Conner | |
| 444,042 | A * | 1/1891 | Brock | 52/578 |
| 446,962 | A * | 2/1891 | Bryce | 52/316 |
| 623,562 | A | 4/1899 | Rider | |
| 714,987 | A | 12/1902 | Wolfe | |
| 753,791 | A | 3/1904 | Fulghum | |
| 1,124,228 | A | 1/1915 | Houston | |
| 1,407,679 | A | 2/1922 | Ruthrauff | |
| 1,454,250 | A | 5/1923 | Parsons | |
| 1,468,288 | A | 9/1923 | Een | |
| 1,477,813 | A | 12/1923 | Daniels | |
| 1,510,924 | A | 10/1924 | Daniels et al. | |
| 1,540,128 | A | 6/1925 | Houston | |
| 1,575,821 | A | 3/1926 | Daniels | |
| 1,602,256 | A | 10/1926 | Sellin | |
| 1,602,267 | A | 10/1926 | Karwisch | |
| 1,615,096 | A | 1/1927 | Meyers | |
| 1,622,103 | A | 3/1927 | Fulton | |
| 1,622,104 | A | 3/1927 | Fulton | |
| 1,637,634 | A | 8/1927 | Carter | |
| 1,644,710 | A | 10/1927 | Crooks | |

(Continued)

FOREIGN PATENT DOCUMENTS

| | | |
|---|---|---|
| AT | 005566 | 8/2002 |

(Continued)

OTHER PUBLICATIONS

Webster Dictionary, p. 862.

(Continued)

*Primary Examiner* — Brian Glessner
*Assistant Examiner* — Jessie Fonseca
(74) *Attorney, Agent, or Firm* — Andrew M. Calderon; Roberts Mlotkowski Safran & Cole, P.C.

(57) ABSTRACT

The invention is directed to a panel, in particular floor panel, having a core made of a woodbased material and having a decoration applied to a visible side, the visible side being provided, on at least one side edge (I, II), with a chamfer running at an angle thereto, and the chamfer likewise being provided with a decoration, characterized in that a relief is stamped into the surface of the chamfer.

13 Claims, 1 Drawing Sheet

U.S. PATENT DOCUMENTS

| | | | | | |
|---|---|---|---|---|---|
| 1,660,480 | A | | 2/1928 | Daniels | |
| 1,714,738 | A | | 5/1929 | Smith | |
| 1,718,702 | A | | 6/1929 | Pfiester | |
| 1,734,826 | A | | 11/1929 | Pick | |
| 1,764,331 | A | | 6/1930 | Moratz | |
| 1,776,188 | A | | 9/1930 | Langb'aum | |
| 1,778,069 | A | | 10/1930 | Fetz | |
| 1,779,729 | A | | 10/1930 | Bruce | |
| 1,787,027 | A | | 12/1930 | Wasleff | |
| 1,823,039 | A | | 9/1931 | Gruner | |
| 1,859,667 | A | | 5/1932 | Gruner | |
| 1,898,364 | A | | 2/1933 | Gynn | |
| 1,906,411 | A | | 5/1933 | Potvin | |
| 1,921,164 | A | | 8/1933 | Lewis | |
| 1,929,871 | A | | 10/1933 | Jones | |
| 1,940,377 | A | | 12/1933 | Storm | |
| 1,946,648 | A | | 2/1934 | Taylor | |
| 1,953,306 | A | | 4/1934 | Moratz | |
| 1,986,739 | A | | 1/1935 | Mitte | |
| 1,988,201 | A | | 1/1935 | Hall | |
| 2,016,567 | A | * | 10/1935 | Zinser | 428/106 |
| 2,023,066 | A | | 12/1935 | Curtis et al. | |
| 2,044,216 | A | | 6/1936 | Klages | |
| 2,065,525 | A | | 12/1936 | Hamilton | |
| 2,123,409 | A | | 7/1938 | Elmendorf | |
| 2,220,606 | A | | 11/1940 | Malarkey et al. | |
| 2,276,071 | A | | 3/1942 | Scull | |
| 2,280,071 | A | | 4/1942 | Hamilton | |
| 2,324,628 | A | | 7/1943 | Kähr | |
| 2,328,051 | A | | 8/1943 | Bull | |
| 2,398,632 | A | | 4/1946 | Frost et al. | |
| 2,430,200 | A | | 11/1947 | Wilson | |
| 2,740,167 | A | | 4/1956 | Rowley | |
| 2,894,292 | A | | 7/1959 | Gramelspacker | |
| 3,045,294 | A | | 7/1962 | Livezey, Jr. | |
| 3,100,556 | A | | 8/1963 | De Ridder | |
| 3,125,138 | A | | 3/1964 | Bolenbach | |
| 3,182,769 | A | | 5/1965 | De Ridder | |
| 3,203,149 | A | | 8/1965 | Soddy | |
| 3,204,380 | A | | 9/1965 | Smith et al. | |
| 3,267,630 | A | | 8/1966 | Omholt | |
| 3,282,010 | A | | 11/1966 | King, Jr. | |
| 3,286,006 | A | | 11/1966 | Annand | |
| 3,310,919 | A | | 3/1967 | Bue et al. | |
| 3,347,048 | A | | 10/1967 | Brown et al. | |
| 3,460,304 | A | | 8/1969 | Braeuninger et al. | |
| 3,481,810 | A | | 12/1969 | Waite | |
| 3,526,420 | A | | 9/1970 | Brancaleone | |
| 3,538,665 | A | | 11/1970 | Gohner | |
| 3,553,919 | A | | 1/1971 | Omholt | |
| 3,555,762 | A | | 1/1971 | Costanzo, Jr. | |
| 3,608,258 | A | | 9/1971 | Spratt | |
| 3,630,817 | A | * | 12/1971 | Winkowski | 428/164 |
| 3,640,797 | A | * | 2/1972 | Taguchi et al. | 428/114 |
| 3,654,044 | A | * | 4/1972 | Hirota | 428/151 |
| 3,694,983 | A | | 10/1972 | Couquet | |
| 3,714,747 | A | | 2/1973 | Curran | |
| 3,720,027 | A | | 3/1973 | Christensen | |
| 3,729,368 | A | * | 4/1973 | Inghame et al. | 428/101 |
| 3,731,445 | A | | 5/1973 | Hoffmann et al. | |
| 3,759,007 | A | | 9/1973 | Thiele | |
| 3,760,548 | A | | 9/1973 | Sauer et al. | |
| 3,768,846 | A | | 10/1973 | Hensley et al. | |
| 3,853,578 | A | | 12/1974 | Suzuki et al. | |
| 3,859,000 | A | | 1/1975 | Webster | |
| 3,878,030 | A | | 4/1975 | Cook | |
| 3,902,293 | A | | 9/1975 | Witt et al. | |
| 3,908,053 | A | | 9/1975 | Hettich | |
| 3,912,569 | A | | 10/1975 | Kapral | |
| 3,936,551 | A | | 2/1976 | Elmendorf et al. | |
| 3,988,187 | A | | 10/1976 | Witt et al. | |
| 4,006,048 | A | | 2/1977 | Cannady, Jr. et al. | |
| 4,033,082 | A | * | 7/1977 | Tashiro | 52/316 |
| 4,084,996 | A | | 4/1978 | Wheeler | |
| 4,090,338 | A | | 5/1978 | Bourgade | |
| 4,091,136 | A | | 5/1978 | O'Brian et al. | |
| 4,099,358 | A | | 7/1978 | Compaan | |
| 4,104,429 | A | * | 8/1978 | Colledge | 428/151 |
| 4,118,533 | A | | 10/1978 | Hipchen et al. | |
| 4,131,705 | A | | 12/1978 | Kubinsky | |
| 4,141,944 | A | * | 2/1979 | Anstadt et al. | 264/45.5 |
| 4,164,832 | A | | 8/1979 | Van Zandt | |
| 4,169,688 | A | | 10/1979 | Toshio | |
| 4,242,390 | A | | 12/1980 | Nemeth | |
| 4,243,716 | A | | 1/1981 | Kosaka et al. | |
| 4,245,689 | A | | 1/1981 | Grard et al. | |
| 4,246,310 | A | | 1/1981 | Hunt et al. | |
| 4,290,248 | A | | 9/1981 | Kemerer et al. | |
| 4,299,070 | A | | 11/1981 | Oltmanns et al. | |
| 4,426,820 | A | | 1/1984 | Terbrack et al. | |
| 4,431,044 | A | | 2/1984 | Bruneau | |
| 4,471,012 | A | | 9/1984 | Maxwell | |
| 4,501,102 | A | | 2/1985 | Knowles | |
| 4,520,062 | A | | 5/1985 | Ungar et al. | |
| 4,561,233 | A | | 12/1985 | Harter et al. | |
| 4,585,685 | A | | 4/1986 | Forry et al. | |
| 4,612,745 | A | | 9/1986 | Hovde | |
| 4,641,469 | A | | 2/1987 | Wood | |
| 4,653,242 | A | | 3/1987 | Ezard | |
| 4,654,244 | A | | 3/1987 | Eckert et al. | |
| 4,678,528 | A | * | 7/1987 | Smith et al. | 156/220 |
| 4,703,597 | A | | 11/1987 | Eggemar | |
| 4,715,162 | A | | 12/1987 | Brightwell | |
| 4,738,071 | A | | 4/1988 | Ezard | |
| 4,752,497 | A | | 6/1988 | McConkey et al. | |
| 4,756,951 | A | | 7/1988 | Wang et al. | |
| 4,769,963 | A | | 9/1988 | Meyerson | |
| 4,819,932 | A | | 4/1989 | Trotter, Jr. | |
| 4,831,806 | A | | 5/1989 | Niese et al. | |
| 4,845,907 | A | | 7/1989 | Meek | |
| 4,849,768 | A | | 7/1989 | Graham | |
| 4,905,442 | A | | 3/1990 | Daniels | |
| 4,947,602 | A | | 8/1990 | Pollasky | |
| 5,029,425 | A | | 7/1991 | Bogataj | |
| 5,103,614 | A | | 4/1992 | Kawaguchi et al. | |
| 5,113,632 | A | | 5/1992 | Hanson | |
| 5,117,603 | A | | 6/1992 | Weintraub | |
| 5,122,212 | A | * | 6/1992 | Ferguson et al. | 156/209 |
| 5,136,823 | A | | 8/1992 | Pellegrino | |
| 5,165,816 | A | | 11/1992 | Parasin | |
| 5,179,812 | A | | 1/1993 | Itill | |
| 5,205,091 | A | | 4/1993 | Brown | |
| 5,216,861 | A | | 6/1993 | Meyerson | |
| 5,251,996 | A | | 10/1993 | Hiller et al. | |
| 5,253,464 | A | | 10/1993 | Nilsen | |
| 5,283,102 | A | | 2/1994 | Sweet et al. | |
| 5,295,341 | A | | 3/1994 | Kajiwara | |
| 5,335,473 | A | | 8/1994 | Chase | |
| 5,348,778 | A | | 9/1994 | Knipp et al. | |
| 5,349,796 | A | | 9/1994 | Meyerson | |
| 5,390,457 | A | | 2/1995 | Sjöolander | |
| 5,413,834 | A | | 5/1995 | Hunter et al. | |
| 5,433,806 | A | | 7/1995 | Pasquali et al. | |
| 5,474,831 | A | | 12/1995 | Nystrom | |
| 5,497,589 | A | | 3/1996 | Porter | |
| 5,502,939 | A | | 4/1996 | Zadok et al. | |
| 5,540,025 | A | | 7/1996 | Takehara et al. | |
| 5,567,497 | A | | 10/1996 | Zegler et al. | |
| 5,570,554 | A | | 11/1996 | Searer | |
| 5,573,829 | A | * | 11/1996 | Decker | 428/156 |
| 5,597,024 | A | | 1/1997 | Bolyard et al. | |
| 5,630,304 | A | | 5/1997 | Austin | |
| 5,653,099 | A | | 8/1997 | MacKenzie | |
| 5,671,575 | A | | 9/1997 | Wu | |
| 5,694,734 | A | | 12/1997 | Cercone et al. | |
| 5,706,621 | A | | 1/1998 | Pervan | |
| 5,736,227 | A | | 4/1998 | Sweet et al. | |
| 5,768,850 | A | | 6/1998 | Chen | |
| 5,797,175 | A | | 8/1998 | Schneider | |
| 5,797,237 | A | | 8/1998 | Finkell, Jr. | |
| 5,823,240 | A | | 10/1998 | Bolyard et al. | |
| 5,827,592 | A | | 10/1998 | Van Gulik et al. | |
| 5,834,081 | A | * | 11/1998 | Fanti | 428/44 |
| 5,860,267 | A | | 1/1999 | Pervan | |
| 5,935,668 | A | | 8/1999 | Smith | |
| 5,943,239 | A | | 8/1999 | Shamblin et al. | |
| 5,953,878 | A | | 9/1999 | Johnson | |

| | | | | |
|---|---|---|---|---|
| 5,968,625 | A | 10/1999 | Hudson | |
| 5,985,397 | A | 11/1999 | Witt et al. | |
| 5,987,839 | A | 11/1999 | Hamar et al. | |
| 6,006,486 | A * | 12/1999 | Moriau et al. | 52/589.1 |
| 6,023,907 | A | 2/2000 | Pervan | |
| 6,065,262 | A | 5/2000 | Motta | |
| 6,094,882 | A | 8/2000 | Pervan | |
| 6,101,778 | A | 8/2000 | Martensson | |
| 6,119,423 | A | 9/2000 | Costantino | |
| 6,134,854 | A | 10/2000 | Stanchfield | |
| 6,148,884 | A | 11/2000 | Bolyard et al. | |
| 6,168,866 | B1 | 1/2001 | Clark | |
| 6,182,410 | B1 | 2/2001 | Pervan | |
| 6,186,703 | B1 | 2/2001 | Shaw | |
| 6,205,639 | B1 | 3/2001 | Pervan | |
| 6,209,278 | B1 | 4/2001 | Tychsen | |
| 6,216,403 | B1 | 4/2001 | Belbeoc'h | |
| 6,216,409 | B1 | 4/2001 | Roy et al. | |
| D442,296 | S | 5/2001 | Külik | |
| D442,297 | S | 5/2001 | Külik | |
| D442,298 | S | 5/2001 | Külik | |
| D442,706 | S | 5/2001 | Külik | |
| D442,707 | S | 5/2001 | Külik | |
| 6,224,698 | B1 | 5/2001 | Endo | |
| 6,238,798 | B1 | 5/2001 | Kang et al. | |
| 6,247,285 | B1 * | 6/2001 | Moebus | 52/589.1 |
| D449,119 | S | 10/2001 | Külik | |
| D449,391 | S | 10/2001 | Külik | |
| D449,392 | S | 10/2001 | Külik | |
| 6,324,803 | B1 | 12/2001 | Pervan | |
| 6,345,481 | B1 | 2/2002 | Nelson | |
| 6,363,677 | B1 | 4/2002 | Chen et al. | |
| 6,397,547 | B1 | 6/2002 | Martensson | |
| 6,418,683 | B1 | 7/2002 | Martensson et al. | |
| 6,421,970 | B1 | 7/2002 | Martensson et al. | |
| 6,427,408 | B1 | 8/2002 | Krieger | |
| 6,436,159 | B1 | 8/2002 | Safta et al. | |
| 6,438,919 | B1 | 8/2002 | Knauseder | |
| 6,446,405 | B1 | 9/2002 | Pervan | |
| 6,449,913 | B1 | 9/2002 | Shelton | |
| 6,449,918 | B1 | 9/2002 | Nelson | |
| 6,453,632 | B1 | 9/2002 | Huang | |
| 6,458,232 | B1 | 10/2002 | Valentinsson | |
| 6,460,306 | B1 | 10/2002 | Nelson | |
| 6,461,636 | B1 | 10/2002 | Arth et al. | |
| 6,465,046 | B1 | 10/2002 | Hansson et al. | |
| 6,490,836 | B1 | 12/2002 | Moriau et al. | |
| 6,497,961 | B2 | 12/2002 | Kang et al. | |
| 6,510,665 | B2 | 1/2003 | Pervan | |
| 6,516,579 | B1 | 2/2003 | Pervan | |
| 6,517,935 | B1 | 2/2003 | Komfalt et al. | |
| 6,519,912 | B1 | 2/2003 | Eckmann et al. | |
| 6,521,314 | B2 | 2/2003 | Tychsen | |
| 6,532,709 | B2 | 3/2003 | Pervan | |
| 6,533,855 | B1 | 3/2003 | Gaynor et al. | |
| 6,536,178 | B1 | 3/2003 | Palsson | |
| 6,546,691 | B2 | 4/2003 | Peopolder | |
| 6,553,724 | B1 | 4/2003 | Bigler | |
| 6,558,754 | B1 | 5/2003 | Velin et al. | |
| 6,565,919 | B1 | 5/2003 | Hansson et al. | |
| 6,568,148 | B1 | 5/2003 | Eisermann | |
| 6,569,272 | B2 | 5/2003 | Tychsen | |
| 6,588,166 | B2 | 7/2003 | Martensson et al. | |
| 6,591,568 | B1 | 7/2003 | Palsson | |
| 6,601,359 | B2 | 8/2003 | Olofsson | |
| 6,606,834 | B2 | 8/2003 | Martensson et al. | |
| 6,617,009 | B1 | 9/2003 | Chen et al. | |
| 6,635,174 | B1 | 10/2003 | Berg et al. | |
| 6,641,629 | B2 | 11/2003 | Safta et al. | |
| 6,646,088 | B2 | 11/2003 | Fan et al. | |
| 6,647,690 | B1 | 11/2003 | Martensson | |
| 6,649,687 | B1 | 11/2003 | Gheewala et al. | |
| 6,659,097 | B1 | 12/2003 | Houston | |
| 6,672,030 | B2 | 1/2004 | Schulte | |
| 6,675,545 | B2 | 1/2004 | Chen et al. | |
| 6,681,820 | B2 | 1/2004 | Olofsson | |
| 6,682,254 | B1 | 1/2004 | Olofsson et al. | |
| 6,685,993 | B1 | 2/2004 | Hansson et al. | |
| 6,711,864 | B2 | 3/2004 | Erwin | |
| 6,711,869 | B2 | 3/2004 | Tychsen | |
| 6,715,253 | B2 | 4/2004 | Pervan | |
| 6,723,438 | B2 | 4/2004 | Chang et al. | |
| 6,729,091 | B1 | 5/2004 | Martensson | |
| 6,745,534 | B2 | 6/2004 | Kornfalt | |
| 6,761,008 | B2 | 7/2004 | Chen et al. | |
| 6,761,794 | B2 | 7/2004 | Mott et al. | |
| 6,763,643 | B1 | 7/2004 | Martensson | |
| 6,766,622 | B1 | 7/2004 | Thiers | |
| 6,769,217 | B2 | 8/2004 | Nelson | |
| 6,769,218 | B2 | 8/2004 | Pervan | |
| 6,769,835 | B2 | 8/2004 | Stridsman | |
| 6,772,568 | B2 | 8/2004 | Thiers et al. | |
| 6,786,019 | B2 | 9/2004 | Thiers | |
| 6,803,109 | B2 | 10/2004 | Qiu et al. | |
| 6,805,951 | B2 | 10/2004 | Kornfält et al. | |
| 6,823,638 | B2 | 11/2004 | Stanchfield | |
| 6,841,023 | B2 | 1/2005 | Mott | |
| 2001/0029720 | A1 | 10/2001 | Pervan | |
| 2001/0034992 | A1 | 11/2001 | Pletzer et al. | |
| 2002/0007608 | A1 | 1/2002 | Pervan | |
| 2002/0007609 | A1 | 1/2002 | Pervan | |
| 2002/0014047 | A1 * | 2/2002 | Thiers | 52/313 |
| 2002/0020127 | A1 | 2/2002 | Thiers et al. | |
| 2002/0046528 | A1 | 4/2002 | Pervan et al. | |
| 2002/0056245 | A1 | 5/2002 | Thiers | |
| 2002/0100231 | A1 * | 8/2002 | Miller et al. | 52/177 |
| 2002/0106439 | A1 | 8/2002 | Cappelle | |
| 2002/0160680 | A1 | 10/2002 | Laurence et al. | |
| 2003/0024200 | A1 | 2/2003 | Moriau et al. | |
| 2003/0024201 | A1 | 2/2003 | Moriau et al. | |
| 2003/0029115 | A1 | 2/2003 | Moriau et al. | |
| 2003/0029116 | A1 | 2/2003 | Moriau et al. | |
| 2003/0029117 | A1 | 2/2003 | Moriau et al. | |
| 2003/0033777 | A1 | 2/2003 | Thiers et al. | |
| 2003/0033784 | A1 | 2/2003 | Pervan | |
| 2003/0115812 | A1 | 6/2003 | Pervan | |
| 2003/0115821 | A1 | 6/2003 | Pervan | |
| 2003/0159385 | A1 * | 8/2003 | Thiers | 52/311.1 |
| 2003/0167717 | A1 | 9/2003 | Garcia | |
| 2003/0196405 | A1 | 10/2003 | Pervan | |
| 2003/0205013 | A1 | 11/2003 | Garcia | |
| 2003/0233809 | A1 | 12/2003 | Pervan | |
| 2004/0016196 | A1 | 1/2004 | Pervan | |
| 2004/0035078 | A1 | 2/2004 | Pervan | |
| 2004/0092006 | A1 | 5/2004 | Lindekens et al. | |
| 2004/0105994 | A1 | 6/2004 | Lu et al. | |
| 2004/0139678 | A1 | 7/2004 | Pervan | |
| 2004/0159066 | A1 | 8/2004 | Thiers et al. | |
| 2004/0177584 | A1 | 9/2004 | Pervan | |
| 2004/0200165 | A1 | 10/2004 | Garcia et al. | |
| 2004/0206036 | A1 | 10/2004 | Pervan | |
| 2004/0237447 | A1 | 12/2004 | Thiers et al. | |
| 2004/0237448 | A1 | 12/2004 | Thiers et al. | |
| 2004/0241374 | A1 | 12/2004 | Thiers et al. | |
| 2004/0244322 | A1 | 12/2004 | Thiers et al. | |
| 2004/0250493 | A1 | 12/2004 | Thiers et al. | |
| 2004/0255541 | A1 | 12/2004 | Thiers et al. | |
| 2004/0258907 | A1 | 12/2004 | Kornfalt et al. | |
| 2005/0003149 | A1 | 1/2005 | Kornfalt et al. | |
| 2005/0016099 | A1 | 1/2005 | Thiers | |

FOREIGN PATENT DOCUMENTS

| | | |
|---|---|---|
| AU | 713628 | 5/1998 |
| AU | 200 020703 | 1/2000 |
| BE | 417526 | 1/1936 |
| BE | 417526 | 9/1936 |
| BE | 557844 | 6/1957 |
| BE | 557844 | 3/1960 |
| BE | 09 600527 | 6/1998 |
| BE | 09 700344 | 10/1998 |
| CA | 991373 | 6/1976 |
| CA | 2226286 | 12/1997 |
| CA | 2252791 | 5/1999 |
| CA | 2 289309 | 7/2000 |
| CH | 200949 | 1/1939 |
| CH | 211877 | 1/1941 |
| CH | 562377 | 5/1975 |
| DE | 314207 | 9/1919 |

| | | |
|---|---|---|
| DE | 531989 | 8/1931 |
| DE | 740235 | 10/1943 |
| DE | 1089966 | 9/1960 |
| DE | 1212225 | 3/1966 |
| DE | 1212275 | 3/1966 |
| DE | 1534802 | 4/1970 |
| DE | 7 102476 | 6/1971 |
| DE | 7102476 | 6/1971 |
| DE | 2007129 | 9/1971 |
| DE | 1534278 | 11/1971 |
| DE | 2 252643 | 10/1972 |
| DE | 2238660 | 2/1974 |
| DE | 7402354 | 5/1974 |
| DE | 2502992 | 7/1976 |
| DE | 2616077 | 10/1977 |
| DE | 2917025 | 11/1980 |
| DE | 7911924 | 3/1981 |
| DE | 7928703 | 5/1981 |
| DE | 3041781 | 6/1982 |
| DE | 3214207 | 11/1982 |
| DE | 8226153 | 1/1983 |
| DE | 3343601 | 6/1985 |
| DE | 1534278 | 2/1986 |
| DE | 86 040049 | 6/1986 |
| DE | 3512204 | 10/1986 |
| DE | 3 246376 | 2/1987 |
| DE | 4004891 | 9/1990 |
| DE | 4002547 | 8/1991 |
| DE | 4134452 | 4/1993 |
| DE | 4215273 | 11/1993 |
| DE | 4242530 | 6/1994 |
| DE | 4011656 | 1/1995 |
| DE | 4324137 | 1/1995 |
| DE | 4107151 | 2/1995 |
| DE | 29 517128 | 2/1996 |
| DE | 4242530 | 9/1996 |
| DE | 3544845 | 12/1996 |
| DE | 29 710175 | 9/1997 |
| DE | 19 616510 | 3/1998 |
| DE | 19 651149 | 6/1998 |
| DE | 19 709641 | 9/1998 |
| DE | 19 718319 | 11/1998 |
| DE | 19 735189 | 6/2000 |
| DE | 20 001225 | 8/2000 |
| DE | 19 925248 | 12/2000 |
| DE | 20 017461 | 3/2001 |
| DE | 20 018284 | 3/2001 |
| DE | 20 206460 | 8/2002 |
| DE | 20 218331 | 5/2004 |
| EP | 0 248127 | 12/1987 |
| EP | 0248127 | 12/1987 |
| EP | 0623724 | 11/1994 |
| EP | 0652340 | 5/1995 |
| EP | 0667936 | 8/1995 |
| EP | 0690185 | 1/1996 |
| EP | 0849416 | 6/1998 |
| EP | 0698162 | 9/1998 |
| EP | 0903451 | 3/1999 |
| EP | 0855482 | 12/1999 |
| EP | 0877130 | 1/2000 |
| EP | 0969163 | 1/2000 |
| EP | 0969164 | 1/2000 |
| EP | 0974713 | 1/2000 |
| EP | 0843763 | 10/2000 |
| EP | 1200690 | 5/2002 |
| EP | 1262313 | 12/2002 |
| EP | 0958441 | 7/2003 |
| EP | 1026341 | 8/2003 |
| EP | 1522653 | 8/2004 |
| ES | 163421 | 9/1968 |
| ES | 460194 | 5/1978 |
| ES | 283331 | 5/1985 |
| ES | 1019585 | 12/1991 |
| ES | 1019585 | 1/1992 |
| ES | 2168045 | 5/2002 |
| FI | 843060 | 8/1984 |
| FR | 1293043 | 4/1962 |
| FR | 2691491 | 11/1983 |
| FR | 2568295 | 5/1986 |
| FR | 2623544 | 5/1989 |
| FR | 2630149 | 10/1989 |
| FR | 2637932 | 4/1990 |
| FR | 2675174 | 10/1991 |
| FR | 2667639 | 4/1992 |
| FR | 2691491 | 11/1993 |
| FR | 2697275 | 4/1994 |
| FR | 2712329 | 5/1995 |
| FR | 2776956 | 10/1999 |
| FR | 2781513 | 1/2000 |
| FR | 2785633 | 5/2000 |
| GB | 424057 | 2/1935 |
| GB | 585205 | 1/1947 |
| GB | 599793 | 3/1948 |
| GB | 636423 | 4/1950 |
| GB | 812671 | 4/1959 |
| GB | 1033866 | 6/1966 |
| GB | 1034117 | 6/1966 |
| GB | 1044846 | 10/1966 |
| GB | 1237744 | 6/1968 |
| GB | 1127915 | 9/1968 |
| GB | 1275511 | 5/1972 |
| GB | 1399402 | 7/1975 |
| GB | 1430423 | 3/1976 |
| GB | 2117813 | 10/1983 |
| GB | 2126106 | 3/1984 |
| GB | 2152063 | 7/1985 |
| GB | 2238660 | 6/1991 |
| GB | 2243381 | 10/1991 |
| GB | 2256023 | 11/1992 |
| JP | 54-65528 | 5/1979 |
| JP | 57-119056 | 7/1982 |
| JP | 59-186336 | 10/1984 |
| JP | 3-169967 | 7/1991 |
| JP | 4-106264 | 4/1992 |
| JP | 5-148984 | 6/1993 |
| JP | 6-56310 | 5/1994 |
| JP | 6-146553 | 5/1994 |
| JP | 6-200611 | 7/1994 |
| JP | 6-320510 | 11/1994 |
| JP | 7-76923 | 3/1995 |
| JP | 7-180333 | 7/1995 |
| JP | 7-300979 | 11/1995 |
| JP | 7-310426 | 11/1995 |
| JP | 8-109734 | 4/1996 |
| JP | 8-1097340 | 4/1996 |
| JP | 8-270193 | 10/1996 |
| NE | 7 601773 | 2/1976 |
| NO | 157871 | 2/1988 |
| NO | 305614 | 6/1999 |
| RU | 363795 | 12/1972 |
| SE | 711 4900-9 | 9/1974 |
| SE | 450411 | 6/1987 |
| SE | 450141 | 9/1987 |
| SE | 501014 | 10/1994 |
| SE | 501914 | 6/1995 |
| SE | 502994 | 4/1996 |
| SE | 506254 | 11/1997 |
| SE | 509059 | 11/1998 |
| SE | 509060 | 11/1998 |
| SE | 512290 | 2/2000 |
| SE | 512313 | 2/2000 |
| SE | 0000200-6 | 8/2001 |
| WO | 84/02155 | 6/1984 |
| WO | 87/03839 | 7/1987 |
| WO | 89/08539 | 9/1989 |
| WO | 92/17657 | 10/1992 |
| WO | 93/13280 | 7/1993 |
| WO | 93/19910 | 10/1993 |
| WO | 94/01628 | 1/1994 |
| WO | 94 26999 | 11/1994 |
| WO | 94/26999 | 11/1994 |
| WO | 95/06176 | 3/1995 |
| WO | 96/27719 | 9/1996 |
| WO | 96/27721 | 9/1996 |
| WO | 96/30177 | 10/1996 |

| | | |
|---|---|---|
| WO | 97/47834 | 12/1997 |
| WO | 98/24495 | 6/1998 |
| WO | 98/24994 | 6/1998 |
| WO | 98/38401 | 9/1998 |
| WO | 99 40273 | 8/1999 |
| WO | 99/66151 | 12/1999 |
| WO | WO99/66152 | 12/1999 |
| WO | WO00/06854 | 2/2000 |
| WO | WO00/66856 | 11/2000 |
| WO | WO01/66876 | 9/2001 |
| WO | 0196689 | 12/2001 |
| WO | WO 01/96688 A1 | 12/2001 |

OTHER PUBLICATIONS

Opposition II EPO. 698. 162—Facts—Arguments Evidence (11 pages)—translation.

U.S. Court of Appeals for the Federal Circuit, 02-1222-1291 *Alloc, Inc.* vs. *International Trade Commission*, pp. 1-32.

U.S. Court of Appeals for the Federal Circuit Decision in *Alloc, Inc. et al.* vs. *International Trade Commission and Pergs, Inc. et al.* decided Sep. 10, 2003.

* cited by examiner

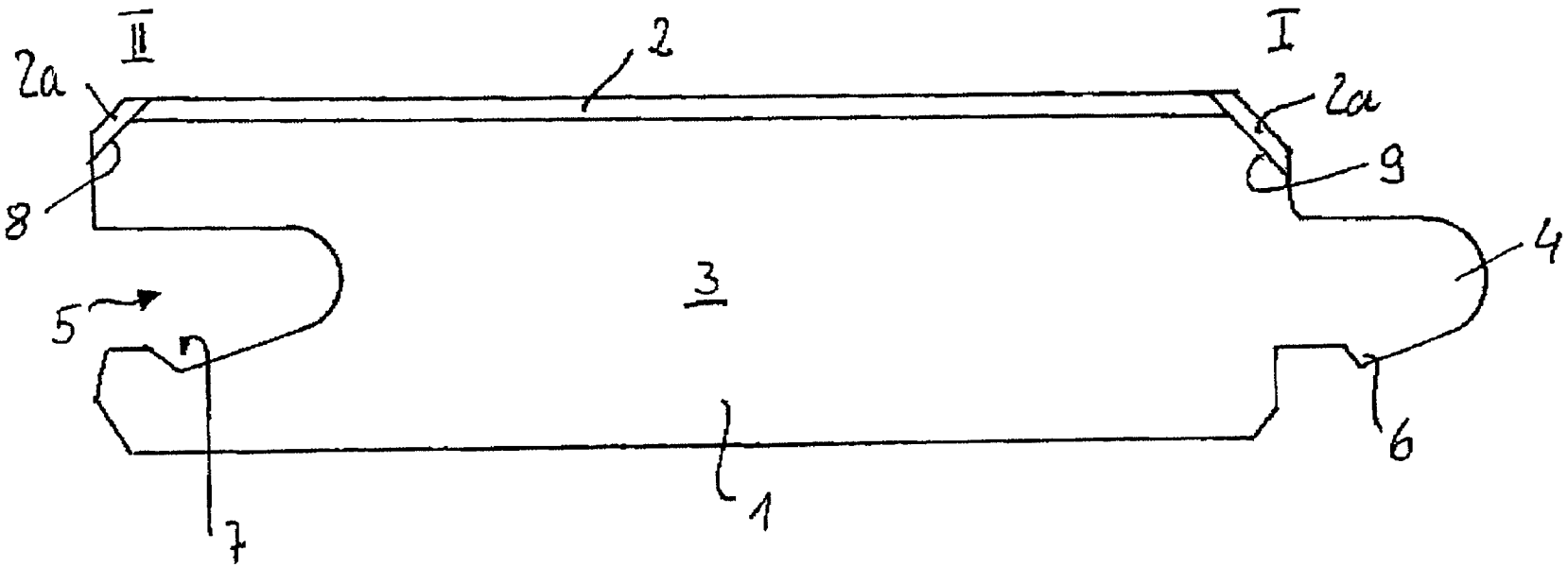
I
II
2
2a
2a
3
4
5
6
7
8
9
1

PANEL

FIELD OF INVENTION

The invention relates to a panel, in particular a floor panel, having a core made of a woodbased material, in particular MDF or HDF, and having a decoration applied to a visible side, the visible side being provided, on at least one side edge, with a chamfer running at an angle thereto, and the chamfer likewise being provided with a decoration.

Such a panel is known, for example, from WO 01/96688.

BACKGROUND DESCRIPTION

In the case of such panels, the decoration is applied to a paper web which, together with a synthetic-resin layer, is pressed with the visible side of the panel. The chamfer is produced by virtue of the side edge being milled. A corresponding decoration strip is then adhesively bonded to the chamfer or the decoration is printed onto the visible side of the chamfer by transfer printing. In particular if the floor panel is made to look like wood, that is to say the printed-on decoration is provided with a structure (differences in color) which corresponds to the grain of real wood, a relief is frequently stamped into the synthetic-resin layer which covers the decorative layer, the intention being for this relief to emphasize, by way of the resulting depressions and elevations, the real-wood character. The relief is destroyed during milling of the chamfer. If the decoration is applied to the chamfer at a later stage, the appearance of the visible surface of the chamfer does not match the appearance of the visible surface of the rest of the panel. For this reason, a relief is not stamped beforehand.

SUMMARY OF THE INVENTION

The invention improves the appearance of the panel described in the introduction.

The invention includes a relief being stamped into the surface of the chamfer.

BRIEF DESCRIPTION OF THE DRAWINGS

FIG. 1 is a side view of a panel in accordance with the Invention.

DETAILED DESCRIPTION OF THE INVENTION

The decoration on the chamfer is preferably covered with a synthetic-resin layer, and the relief is stamped into the synthetic-resin layer. By virtue of this configuration, the appearance and feel are matched to the top side of the panel, with the result that it is possible to use conventional panels which have a stamped-in relief on their visible side.

The decoration is preferably printed directly onto the visible side of the panel and/or of the chamfer. This does away with the decorative paper or the carrier layer which is necessary for the transfer printing, as a result of which the production costs are reduced. Moreover, such a configuration makes it possible to dispense with the practice of applying a synthetic-resin layer first of all. In the case of conventional panels, corundum particles are introduced into the synthetic-resin layer, which is usually a melamine-resin-impregnated paper, in order to increase the abrasion resistance. These corundum particles result in a high level of tool wear. By virtue of the decoration being printed directly onto the panel, it is possible for a melamine resin to be applied in fluid form, or sprayed or rolled, possibly in a number of layers, onto the top side of the panel including the chamfer, the relief being stamped into this melamine resin once the latter has set.

In particular if the decoration has a structure, for example a wood grain, it is advantageous if the stamped-in relief corresponds to the structure. This is preferably achieved by the structure being produced at the same time as the relief. For this purpose, it is possible for the pressing plate designed as a female die, that is to say having in negative form the relief which is to be stamped, to be coated with printing ink. The elevations of the female die, which subsequently constitute depressions of the relief, then do not just stamp the relief into the synthetic-resin layer; rather, at the same time, these depressions are also dyed and then form the structure (grain).

It is preferable for not just one side edge but for two opposite side edges to be provided with a chamfer. In particular, it is advantageous if all the side edges have a chamfer.

The attached drawing illustrates an exemplary embodiment of the invention.

The core 3 of the panel 1 consists of a woodbased material, in particular of MDF or HDF. The panel 1 is provided with a decoration 2 on its visible side. On opposite side edges I, II, the panel 1 has a tongue 4 and a groove 5 corresponding thereto. The tongue 4 and groove 5 are provided with locking means 6, 7 via which two interconnected panels can be locked in relation to one another, with the result that they can be laid without any glue being used. Such panels are referred to as click-in panels.

On the opposite side edges I, II, the panel is provided with a chamfer 8, 9 running at an angle of up to 45°. A decoration 2*a* (for example a wood grain) is applied to the visible side of the chamfers 8, 9 by virtue of dye being sprayed or rolled on directly. It is possible for the decoration to be printed directly onto the visible side of the chamfer 8, 9 or else also to be adhesively bonded thereto as a strip material. A relief is stamped into the surface of the chamfer 8, 9 and forms depressions and elevations on the surface. The relief corresponds to the structure (grain) of the decoration.

While the invention has been described in terms of embodiments, those skilled in the art will recognize that the invention can be practiced with modification within the spirit and scope of the appended claims.

The invention claimed is:

1. A panel comprising a core made of a woodbased material and having a decoration applied to a visible side, the visible side having, on at least one side edge, a chamfer running at an angle thereto, wherein the chamfer includes a decoration, and a relief is stamped into the surface of the chamfer.

2. The panel according to claim 1, wherein the decoration on the chamfer is covered with a synthetic-resin layer, and the relief is stamped into the synthetic-resin layer.

3. The panel according to claim 1, wherein the decoration is printed directly onto at least one of the visible side of the panel and the chamfer.

4. The panel according to claim 1, wherein the decoration on the chamfer has a structure.

5. The panel according to claim 4, wherein the stamped-in relief corresponds to the structure.

6. The panel according to claim 1, wherein two opposite side edges of the at least one side edge have a chamfer.

7. The panel according to claim 6, wherein all the side edges of the at least one side edge have a chamfer.

8. The panel according to claim 4, wherein the structure is a woodgrain.

9. A floor panel, comprising:

a core comprising a woodbased material and a visible side;

a first decoration on the visible side;

at least one side edge;

a chamfer provided on the at least one side edge; and a second decoration applied to a visible side of the chamfer which is a relief stamped forming depressions and elevations on a surface of the chamfer.

10. The floor panel of claim 9, wherein the depressions are dyed.

11. The floor panel of claim 9, wherein the first decoration is printed directly onto the visible side.

12. A floor panel, comprising:

a core comprising a woodbased material having a visible side and at least one side edge;

a first decoration printed directly on the visible side;

a chamfer provided on the at least one side edge;

a second decoration printed directly on the chamfer; and a relief stamped into the surface of the chamfer.

13. The floor panel of claim 12, wherein the relief corresponds to the second decoration.

* * * * *